United States Patent [19]

Allerheiligen

[11] 4,077,667

[45] Mar. 7, 1978

[54] MEANS FOR CUSHIONING WOODEN PEWS OR THE LIKE

[76] Inventor: Arnold G. Allerheiligen, 702 Lincoln St., Holdrege, Nebr. 68949

[21] Appl. No.: 459,063

[22] Filed: Apr. 8, 1974

[51] Int. Cl.[2] ..... A47C 1/02

[52] U.S. Cl. ..... 297/445

[58] Field of Search ..... 297/455, 456, 458, 452, 297/DIG. 2, 451, 450, 426, 158, 218, 219, 461, 462, 232; 5/360

[56] References Cited

U.S. PATENT DOCUMENTS

| | | | |
|---|---|---|---|
| 2,816,601 | 12/1957 | Plummer | 297/450 |
| 3,065,031 | 11/1962 | Henry | 297/450 |
| 3,087,172 | 4/1963 | Arno | 5/360 |
| 3,211,497 | 10/1965 | Bounous | 297/452 |
| 3,252,736 | 5/1966 | Schrock | 297/452 |
| 3,301,597 | 1/1967 | Bereday | 297/450 |
| 3,515,430 | 6/1970 | Nelson | 297/218 |
| 3,567,278 | 3/1971 | Barecki et al. | 297/218 |
| 3,584,916 | 6/1971 | Bayes | 297/450 |
| 3,596,989 | 8/1971 | Van Ryn | 297/219 |

*Primary Examiner*—James T. McCall

*Attorney, Agent, or Firm*—Zarley, McKee, Thomte, Voorhees & Sease

[57] ABSTRACT

The means for cushioning or covering wooden pews or the like comprises back and seat members which are secured to the back and seat portions of the pew respectively. The back member comprises a flat sheet member having a foam material positioned adjacent the forward side thereof and maintained thereon by a fabric material extending thereover and secured to the flat sheet member at the periphery thereof. The seat member comprises a flat sheet member having upstanding supports secured thereto adjacent the back and side edges thereof. A downwardly extending support is secured to the lower front edge of the sheet member. A sheet of foam material is positioned on the upper surface of the flat sheet member and is covered by a fabric material. The method comprises the steps of cushioning or covering the wooden pews or the like.

3 Claims, 7 Drawing Figures

MEANS FOR CUSHIONING WOODEN PEWS OR THE LIKE

BACKGROUND OF THE INVENTION

This invention relates to a means for covering wooden pews or the like and more particularly to a means which permits the pews to be quickly and easily covered with cushioned back and seat members.

Frequently, it is desirable to cushion or upholster wooden pews or the like to provide more comfort. The normal method of cushioning the pews is to secure a foam material or the like to the seat and back portions of the pew and then cover the same with a fabric material which is tacked or otherwise secured to the pew itself. This method is time consuming and requires that an experienced upholsterer to accomplish the same.

Therefore, it is a principal object of the invention to provide an improved method and means for cushioning wooden pews or the like.

A further object of the invention is to provide a means for cushioning wooden pews comprising back and seat members which are quickly and easily secured to the back and seat portions of the pew respectively.

A further object of the invention is to provide a means for cushioning wooden pews or the like which provides maximum comfort and durability.

A further object of the invention is to provide a means for cushioning wooden pews or the like which is attractive in appearance.

A further object of the invention is to provide a means for cushioning wooden pews or the like which is durable in use.

A further object of the invention is to provide a method of cushioning wooden pews or the like which is economical, practical, etc.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
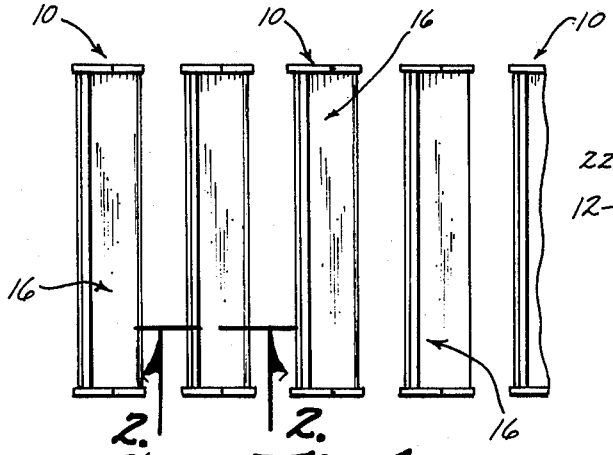
FIG. 1 is a top plan view of pews having the means of this invention secured thereto.
Figure 2:
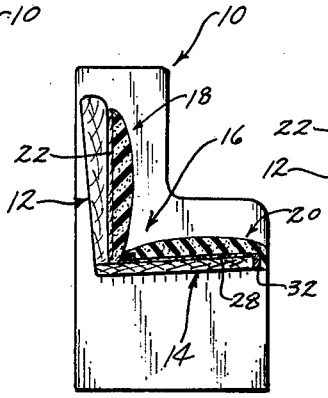
FIG. 2 is a sectional view seen on lines 2—2 of FIG. 1.
Figure 3:
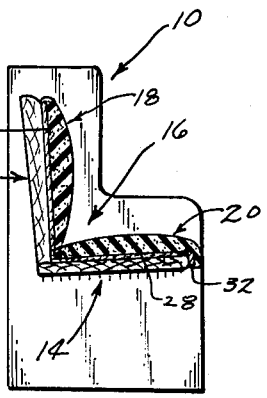
FIG. 3 is a sectional view seen on lines 2—2 of FIG. 1.

In the drawings, the numeral 10 refers generally to a wooden church pew or the like comprising back portion 12 and seat portion 14. The cushioning means of this invention is referred to generally by the reference numeral 16 and comprises back member 18 and seat member 20 which are individually secured to the back and seat portions 12 and 14 respectively as will be described in more detail hereinafter.

Back member 18 comprises a flat generally rectangular sheet member 22 preferably constructed of one-eighth inch Masonite material. A sheet of polyfoam material 24 is positioned adjacent the forward face of the sheet member 22 and has its peripheral edges extending around the periphery of the sheet member 22 as illustrated in the drawings. The layer of foam is preferably one inch thick and has a density of fifteen pounds. The foam material 24 is maintained in position by a layer of fabric material 26 which extends thereover and which has its periphery stapled or otherwise secured to the rearward side of the member 22 at the periphery thereof. Back member 18 is secured to back portion 12 by any convenient means such as brads or the like so that its lower edge is in engagement with the upper surface of seat portion 14 or so that is is spaced slightly thereabove if the rearward edge of the seat member 20 is in engagement with the back portion 12.

Figure 4:
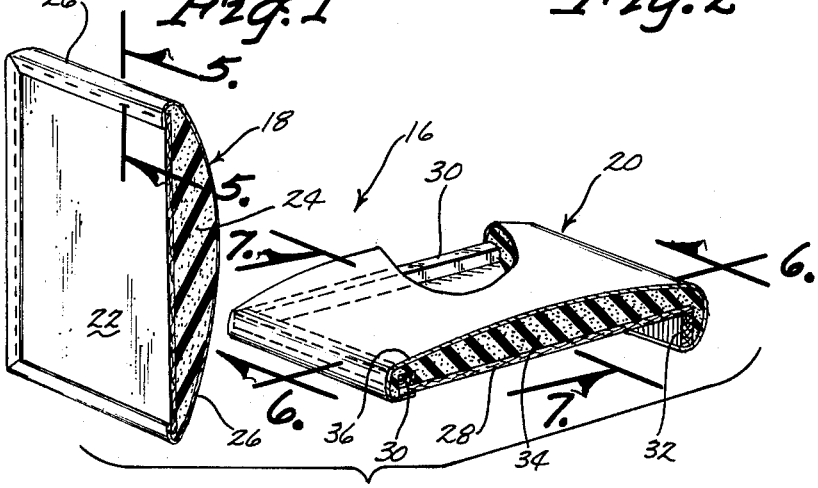
FIG. 4 is a partial exploded perspective view of the device of this invention.
Figure 5:
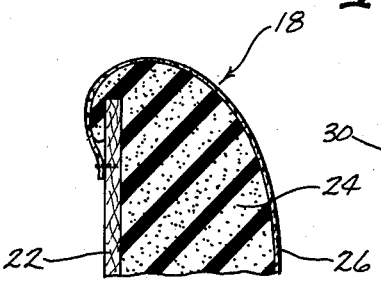
FIG. 5 is a partial sectional view of the back member as seen on lines 5—5 of FIG. 4.
Figure 6:
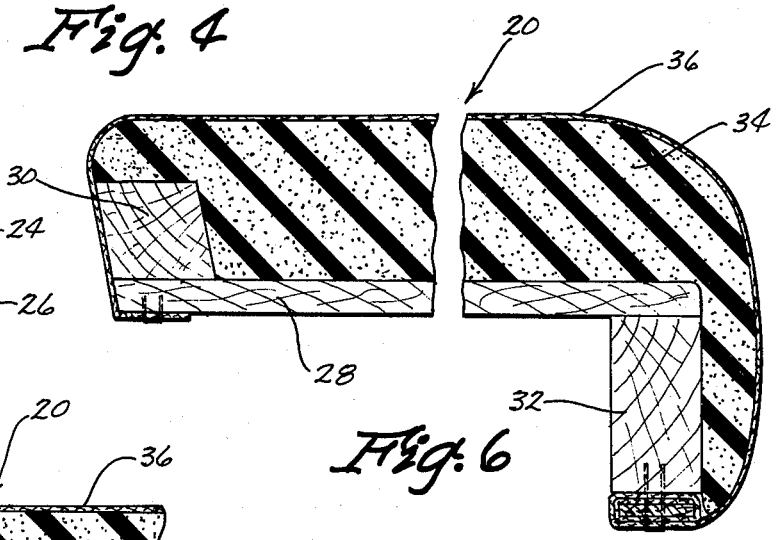
FIG. 6 is a partial sectional view seen on lines 6—6 of FIG. 4.
Figure 7:
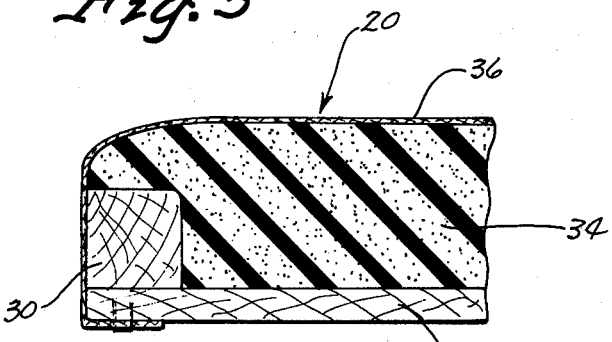
FIG. 7 is a partial sectional view seen on lines 7—7 of FIG. 9.

Seat member 20 generally comprises a flat sheet 28 preferably constructed of three-eights inch plywood. Upstanding support member 30 are secured to the sheet member 28 at the opposite ends and the back edge thereof as seen in the drawings. Preferably, the support members 30 are glued and stapled to the sheet member 28. The forward ends of the opposite end supports 30 are beveled at while the rearward and forward top edges of back edge support member 30 are also beveled. The numeral 32 refers to a support member which extends downwardly from the lower forward portion of sheet member 28 as seen in the drawings. As seen in the drawings, support member 32 is positioned adjacent the forward edge of seat portion 14. The numeral 34 refers to a layer of polyfoam material which is positioned on sheet member 28 as illustrated. The rearward end of the foam layer 34 is positioned on the upper surface of back edge support member 30 and the ends of the foam material 34 are positioned on the upper surface of the opposite end support members 30. As seen in FIG. 4, the forward ends of the foam layer 34 extends downwardly over the forward end of the sheet members 28 and the support member 32 so that the foam extends partially beneath the support. The foam layer 42 is maintained in position by staples extending therethrough into the supports 30. The numeral 36 refers to a layer of fabric material or the like which has its periphery secured to the sheet member as seen in the drawings Seat member 20 is secured to seat portion 14 by any convenient means such as screws or the like extending upwardly through the seat portion 14 and into seat member 20. Preferably, foam layer 34 is one and one-half inches thick and has a density of forty-four pounds. The length and width of seat member 20 will vary depending upon the particular dimensions of the pew upon which it will be installed as is also the case with the back member 18.

Thus it can be seen that a novel means has been described to more quickly and easily cushion a wooden pew or the like. The back and seat members 18 and 20 may be fabricated at the factory and shipped to the place of installation whereupon a person having limited skill could quickly and easily attach the seat and back members to the pew as described in an extremely economical manner. The design of the cushioning means 18 is such that maximum comfort and durability is achieved. The design of the means is also such that the foam will be positively maintained in the proper position thereby avoiding bumps, bulges, etc. or other objectionably shifting of the foam material. Thus it can be seen that a method and means for cushioning wooden pews has been described which accomplishes at least all of its stated objectives.

I claim:

1. A pre-fabricated z-piece means for cushioning pews or the like having seat and back portions and a forward edge, comprising, a seat member secured to the seat portion of the pew comprising a first flat sheet member, said first sheet member having opposite ends, and rearward and forward edges, a first layer of resilient material positioned adjacent the top surface of said first flat sheet member, and a first flexible cover extending over the top surface of said first layer of resilient material, said first flexible cover being secured at its periphery to said first sheet member, a back member secured to the back portion of the pew comprising a second flat sheet member, a second layer of resilient material positioned adjacent the front surface of said second sheet member, and a second flexible cover extending over the frame surface of said second layer of resilient material, said second flexible cover being secured at its periphery to said second sheet member, a first rigid support member secured to the forward edge of said first sheet member and extending downwardly therefrom, forwardly of said seat portion and having a forward side, the forward edge of said first sheet member being positioned forwardly of the forward edge of the seat portion, said first layer of resilient material extending downwardly over said forward edge and being positioned adjacent the forward side thereof, said first flexible cover extending downwardly over said downwardly extending portion of said first layer of resilient material and being secured to said first support member, said first layer of resilient material being positioned adjacent the forward side of said first support member, said first support member being positioned adjacent to and forwardly of the forward edge of said seat portion, said first support member having a substantially rectangular cross-section with its major axis disposed in a substantially vertical position so that said first support member substantially covers the forward edge of said seat portion.

2. The means of claim 1 wherein upstanding rigid support members are secured to said sheet member at the rearward edge and opposite ends thereof, said first layer of resilient material having its peripheral edges positioned on and secured to said support members.

3. The means of claim 2 wherein said upstanding support member at the rearward edge of said first sheet member has a beveled rearward portion complementary to said back portion so that the rearward end of said first sheet member and said support member may be closely positioned to said back portion.

* * * * *